US011367419B1

(12) United States Patent
Ettinger

(10) Patent No.: US 11,367,419 B1
(45) Date of Patent: Jun. 21, 2022

(54) CAPO-LIGHT SYSTEM

(71) Applicant: Brett Ettinger, Rahway, NJ (US)

(72) Inventor: Brett Ettinger, Rahway, NJ (US)

( * ) Notice: Subject to any disclaimer, the term of this patent is extended or adjusted under 35 U.S.C. 154(b) by 359 days.

(21) Appl. No.: 16/781,127

(22) Filed: Feb. 4, 2020

(51) Int. Cl.

| | |
|---|---|
| ***G10D 3/053*** | (2020.01) |
| ***H04R 1/08*** | (2006.01) |
| ***G10H 1/00*** | (2006.01) |
| ***G10H 1/44*** | (2006.01) |
| ***F21V 21/32*** | (2006.01) |
| ***H05B 45/10*** | (2020.01) |
| ***H05B 47/19*** | (2020.01) |
| ***H05B 47/105*** | (2020.01) |
| ***F21V 21/088*** | (2006.01) |
| ***H05B 45/20*** | (2020.01) |
| *F21Y 115/10* | (2016.01) |

(52) U.S. Cl.
CPC ..... *G10D 3/053* (2020.02); *F21V 21/088* (2013.01); *F21V 21/32* (2013.01); *G10H 1/0008* (2013.01); *G10H 1/44* (2013.01); *H04R 1/08* (2013.01); *H05B 45/10* (2020.01); *H05B 45/20* (2020.01); *H05B 47/105* (2020.01); *H05B 47/19* (2020.01); *F21Y 2115/10* (2016.08); *G10H 2210/066* (2013.01); *G10H 2210/076* (2013.01); *G10H 2220/021* (2013.01)

(58) Field of Classification Search
CPC ..... G10D 3/053; G10D 1/0008; G10D 1/44; G10D 2210/066; G10D 2210/076; G10D 2220/021; H05B 45/20; H05B 45/10; H05B 47/105; H05B 47/19; F21V 21/088; F21V 21/32; H04R 1/08; G10H 2210/066; G10H 2210/076; G10H 2210/021; F21Y 2115/10
See application file for complete search history.

(56) References Cited

U.S. PATENT DOCUMENTS

| | | | | |
|---|---|---|---|---|
| 807,950 | A | 12/1905 | Longline et al. | |
| 8,809,655 | B1 * | 8/2014 | Warwick | G10D 3/053 84/318 |
| 9,230,519 | B1 | 1/2016 | Beller | |

* cited by examiner

*Primary Examiner* — Anne M Hines
(74) *Attorney, Agent, or Firm* — Sanchelima & Associates, P.A.; Christian Sanchelima; Jesus Sanchelima

(57) ABSTRACT

A capo-light system is disclosed herein. The capo-light system includes a capo device and an electronic handheld device. The capo device is coupled at a defined portion of a stringed instrument. Additionally, the capo device includes a clamp member configured to be coupled to strings of stringed instrument at defined portion. A light source is positioned at an end of a retractable arm attached to clamp member and configured to provide a first set of functionalities. Furthermore, a microphone is positioned at the clamp member and configured to provide a second set of functionalities. An electronic handheld device is coupled to capo device via a communication network and is configured to control the first set of functionalities associated with the light source and the second set of functionalities associated with the microphone.

11 Claims, 2 Drawing Sheets

CAPO-LIGHT SYSTEM

BACKGROUND OF THE INVENTION

1. Field of the Invention

The present disclosure relates to a capo-light system. More particularly, present disclosure relates to a capo-light system for illuminating stringed instruments.

2. Description of the Related Art

A capo is a device used by a musician on the neck of a stringed (typically fretted) instrument, such as guitars, mandolins, violins, banjos, ukuleles, bouzoukis and the like. The purpose of using the capo is to shorten the playable length of the strings, hence raising the pitch of a fretted instrument so they can play in a different key using same fingerings as playing open (i.e. without a capo). In effect, capo uses a fret of an instrument to create a new nut at a higher note than the instrument's actual nut. In certain scenarios, such as low-visibility (or dark) environment, the musician may not be able to see what he/she is playing.

Applicant believes that a related reference corresponds to a U.S. Pat. No. 9,230,519 that discloses a clip on guitar string illuminating light which also serves as a tune changing capo, U.S. Pat. No. 8,809,655 that discloses a multi-functional decorative capo for a guitar wherein the capo can have an integral light, and U.S. Design Pat. Des. 807,950 that illustrates an ornamental design for a side mount capo.

However, the above references differ from the present invention because the present invention discloses a capo-light system for illuminating stringed instruments.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a capo-light system for illuminating stringed instruments and avoid the drawbacks of the prior art.

It is another object of the present invention to provide a capo-light system that provides a user optimal visibility of the neck of their stringed instrument in a dark environment.

It is yet another object of the present invention to provide a capo-light system that includes a phone application configured to assist a user in customizing the lights of the capo-light system to suit their needs.

It is yet another object of the present invention to provide a capo-light system that includes a phone application configured to aid a user in tuning their stringed instrument and records the audio being produced by the instrument.

Further objects of invention will be brought out in following part of specification, wherein detailed description is for purpose of fully disclosing invention without placing any limitations thereon.

BRIEF DESCRIPTION OF DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described. Various features and embodiments of a capo-light system are explained in conjunction with the description of FIGS. 1 and 2.

Figure 1:
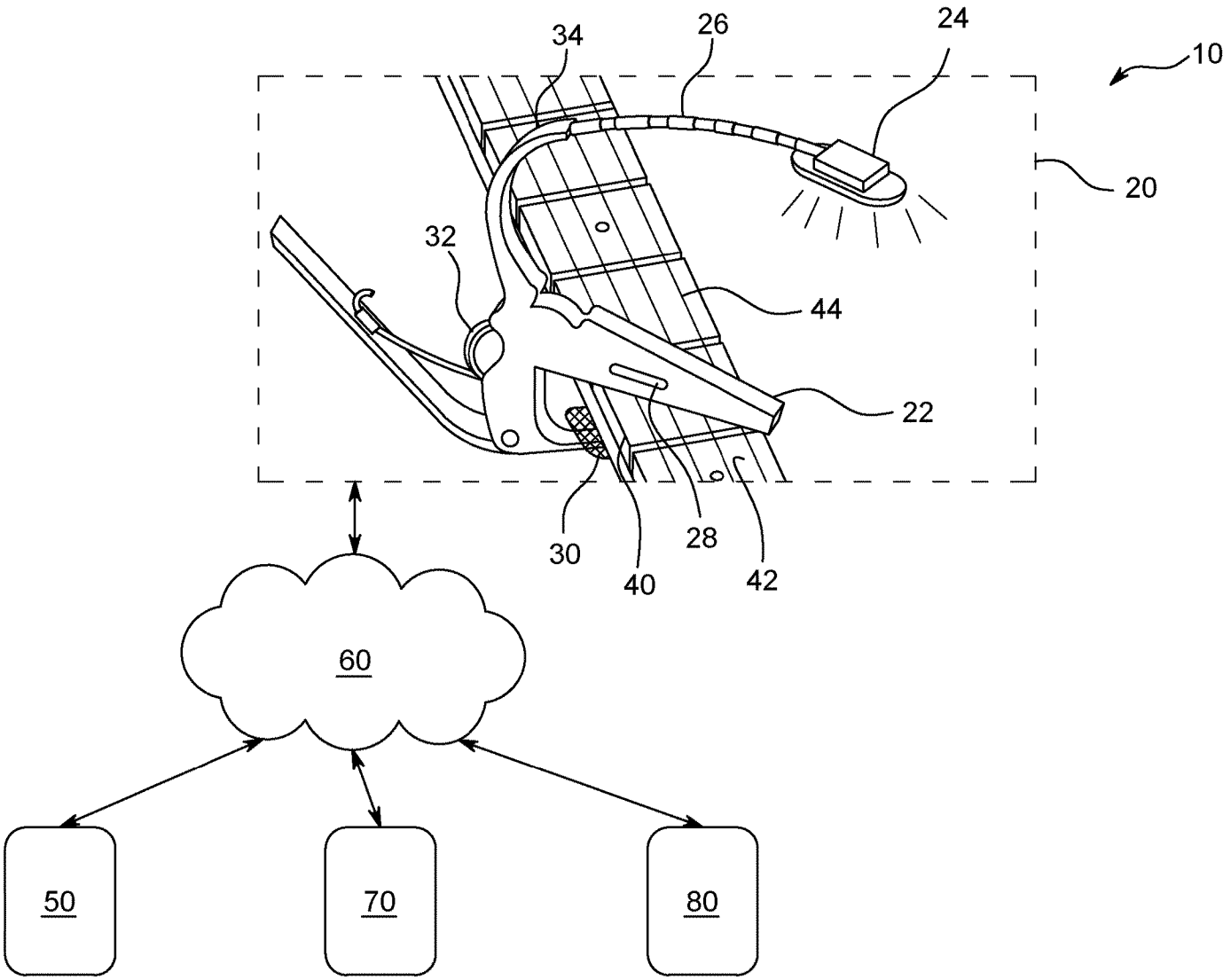
FIG. 1 represents a capo-light system 10 of present invention, according to various embodiments described herein.
Figure 2:
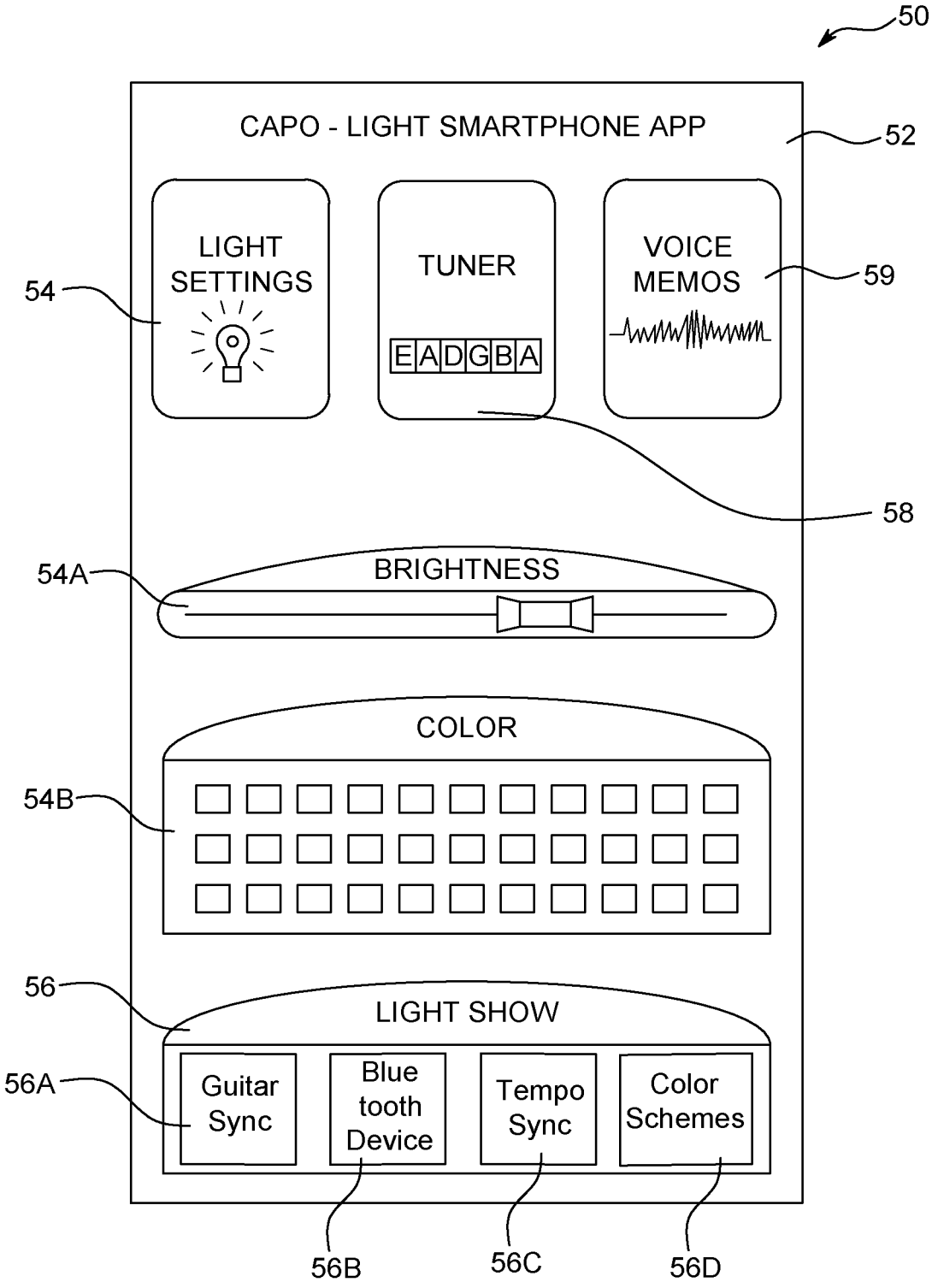
FIG. 2 represents an exemplary electronic handheld device 50 in capo-light system 10 of present invention, according to various embodiments described herein.

FIG. 1 represents a capo-light system 10 of present invention, according to various embodiments described herein. FIG. 1 is described in conjunction with FIG. 2, wherein FIG. 2 represents an electronic handheld device 50 in capo-light system 10 of present invention, according to various embodiments described herein.

As illustrated, capo-light system 10 may comprise a capo device 20, a stringed instrument 40, and electronic handheld device 50 coupled to each other via a communication network 60. Capo device 20 may be configured to be coupled at a defined area 42 of stringed instrument 40.

Capo device 20 may comprise a clamp member 22 configured to be coupled to strings 44 of stringed instrument 40 at defined area 42. In an embodiment, defined area 42 may correspond to a neck area of stringed instrument 40. In an embodiment, defined area 42 may correspond to an area proximate to headstock of stringed instrument 40.

Capo device 20 may further comprise a light source 24 positioned at an end of a retractable arm 26. In one embodiment, retractable arm 26 may be made of a flexible plastic material allowing a user to easily change the direction of the arm while attached to the stringed instrument. Retractable arm 26 may be attached to clamp member 22 through a fixed arm (or non-retractable) member 34. In one embodiment, retractable arm 26 is attached to an upper top edge of fixed arm member 34. The retractable arm 26 may then include a radius of curvature extending over a top end of the stringed instrument. In one embodiment, retractable arm 26 may be an elongated cylindrical tubing having a plurality of ridges along an outer surface area. The ridges aid a user in maneuvering the retractable arm into a comfortable position. A light source 24 is then mounted onto a distal most end of the retractable arm 26. Light source 24 may in the form of an oval member with a rectangular back end. The rectangular back end then receives the retractable arm 26 to be mounted thereon. In one embodiment oval member includes a light source 24 in the form of an LED light therein. The oval member may then be enclosed in a glass dome to help amplify the intensity of the light. Capo device 20 may further include a support member 30 (which is a padded member) hinged to clamp member 22 through a biasing member 32 (which may be a spring member). In an embodiment, light source 24 may correspond to light emitting diodes (LEDs). In an embodiment, light source 24 may be accessed and managed through an app 52 installed at electronic handheld device 50.

Light source 24 may be configured to provide a first set of functionalities. As illustrated in FIG. 2, first set of functionalities may include light settings 54. Light settings 54 may include changing of one or more characteristics, such as brightness 54A and color 54B, of light source 24. Further, first set of functionalities may include controlling light show 56 that includes a first setting 56A, a second setting 56B, a third setting 56C, and a fourth setting 56D.

In an embodiment, first setting 56A may be configured to synchronize light source 24 with sound of stringed instrument 40 using microphone 28. In an embodiment, second setting 56B may be configured to synchronize light source 24 with one of a stage light control system 70 or a Bluetooth electronic device 80. In an embodiment, third setting 56C may be configured to synchronize light source 24 with tempo of musical notes being played at stringed instrument 40. In an embodiment, fourth setting 56D may be configured to select different color schemes and/or pattern for light source 24.

Capo device 20 may further comprise a microphone 28 positioned at clamp member 22. In an embodiment, microphone 28 may be accessed and managed through app 52 installed at electronic handheld device 50.

Microphone 28 may be configured to provide a second set of functionalities. In an embodiment, second set of functionalities may include using microphone 28 as a tuner 58 for stringed instrument 40. Further, second set of functionalities may include providing voice memos 59 for recording, using microphone 28, musical notes being played at stringed instrument 40.

Stringed instrument 40 is a musical instrument that produces sound by means of vibration of strings. Various examples of stringed instrument 40 may include, but are not limited to, guitars, mandolins, violins, banjos, ukuleles, and bouzoukis. Some of the common parts of stringed instrument 40, such as a guitar, may include (1) body which is a large and hollow on an acoustic to amplify the sound, (2) a neck that sticks out from body and connects to a headstock, (3) headstock which is at top of the guitar where the tuning pegs sit, (4) strings that can be made up of steel or nylon, (5) frets that are hard metal strips installed into fingerboard on top of neck, (6) pegs/tuners that sit in headstock and hold one end of each string, (7) nuts that sit at the end of neck and provide an ending point for vibration of string so open notes can be played, (7) fingerboard that is on top of neck on which frets are installed and where strings are pressed down to create notes, (8) bridge that sits on sound board and where other end of strings are attached, and (9) pickguard that helps to protect soundboard from getting scratched when playing.

Electronic handheld device 50 may be a portable mobile deice, for example a smart phone or a tablet, that may be coupled to capo device 20 via communication network 60. Electronic handheld device 50 may be configured to provide a user interface to present multiple control buttons and/or options using which a user, such as musician, may control first set of functionalities associated with light source 24 and second set of functionalities associated with microphone 28.

Communication network 60 may be a short-range network, such as Bluetooth®, via which capo device 20 may be paired with stringed instrument 40, electronic handheld device 50, stage light control system 70, and Bluetooth electronic device 80, according to various embodiments described herein.

Stage light control system 70 may include a lighting control console (also called a lightboard, lighting board, or lighting desk) used in stage/theatrical lighting design and configured to control multiple lights at once in a facility, such as a theater or a stage. Such lighting control console may be configured to control dimmers which further control the intensity of the lights installed in facility. In some embodiments, such lighting control console may control intelligent lighting (i.e. lights that can move, change colors and gobo patterns), fog machines and hazers, and other special effects devices. In some embodiments, such lighting control console may also interface and synchronize with other electronic performance hardware, such as capo device 20, sound boards, projectors, media servers, automated winches, and the like, to enhance audience experience.

Bluetooth electronic device 80 may correspond to an electronic device that is Bluetooth-enabled and may be paired and synchronized with capo device 20 via communication network 60.

Proposed capo-light system 10, as a clip, is attached to stringed instrument 40 to raise relative pitch by half steps, and additionally provide various advantages over conventionally used illumination systems. App 52 may be configured to control various functionalities of capo device 20.

Due to the presence of light source 24, proposed capo-light system 10 may be highly effective in low-visibility (or dark) environment, thereby enabling musician to see what he/she is playing. By use of app 52, also be made to light up in sync with the sounds of the stringed instrument 40 being played. In other words, light source 24 may be flashed upon being triggered with vibration of stringed instrument 40 in real time. Color of light source 24 may be changed and controlled with app 52.

Due to the presence of microphone 28, proposed capo-light system 10 may provide voice memos 59 (or voice note feature). For example, a musician made up a riff that he wants to capture on the spot. Then he can use the microphone 28 to capture a voice memo that is saved on the phone. Lastly, capo-light system 10 may be used as tuner 58 when used in combination with app 52.

Proposed capo-light system 10 may further enhance the impact of performance of musician as it may serve as a visual delight for audience. Proposed capo-light system 10 is really easy to install, easy to use, durable, easy to store, easy to stack, and does not take much space.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A capo-light system, comprising:

a. a capo device configured to be coupled at a defined area of a stringed instrument, wherein said capo device comprises:

a clamp member configured to be coupled to strings of said stringed instrument at said defined area;

a light source positioned at an end of a retractable arm attached to said clamp member configured to provide a first set of functionalities; and a microphone positioned at said clamp member configured to provide a second set of functionalities; and b. an electronic handheld device coupled to said capo device via a communication network, said electronic handheld device being configured to control said first set of functionalities associated with said light source and said second set of functionalities associated with said microphone.

2. The capo-light system of claim 1, wherein said defined area corresponds to a neck area or an area proximate to headstock of said stringed instrument.

3. The capo-light system of claim 1, wherein said light source and said microphone are accessed and managed through an app installed at said electronic handheld device.

4. The capo-light system of claim 1, wherein said first set of functionalities include light settings, wherein said light settings include changing of one or more of a brightness or color of light source.

5. The capo-light system of claim 1, wherein said first set of functionalities include controlling light show includes a first setting for synchronization of said light source with sound of said stringed instrument using said microphone.

6. The capo-light system of claim 5, wherein said light show includes a second setting for synchronization of said light source with one of a stage light control system or a Bluetooth electronic device.

7. The capo-light system of claim 5, wherein said light show includes a third setting for synchronization of said light source with tempo of musical notes being played at said stringed instrument.

8. The capo-light system of claim 5, wherein said light show includes a fourth setting for selection of different color schemes and/or pattern for said light source.

9. The capo-light system of claim 1, wherein said second set of functionalities include using said microphone as a tuner for said stringed instrument.

10. The capo-light system of claim 1, wherein said second set of functionalities include providing voice memos for recording, using said microphone, musical notes being played at said stringed instrument.

11. A capo-light system, comprising:

a. a capo device configured to be coupled at a defined area of a stringed instrument, wherein said capo device comprises:

a clamp member configured to be coupled to strings of said stringed instrument at said defined area;

a light source positioned at an end of a retractable arm attached to said clamp member configured to provide a first set of functionalities, wherein said retractable arm is an elongated cylindrical tube having a plurality of ridges defining portions of said retractable arm, wherein said light source is an LED light source housed within an oval member having a rectangular back end, wherein said rectangular back end receives said retractable arm, said oval member including a glass dome encasing said light source configured to amplify said light source; and a microphone positioned at said clamp member configured to provide a second set of functionalities; and b. an electronic handheld device coupled to said capo device via a communication network, said electronic handheld device being configured to control said first set of functionalities associated with said light source and said second set of functionalities associated with said microphone.

* * * * *